US010683154B2

(12) United States Patent
Hammerschmidt

(10) Patent No.: US 10,683,154 B2
(45) Date of Patent: Jun. 16, 2020

(54) RETENTION PACKAGING ASSEMBLY

(71) Applicant: Sealed Air Corporation (US), Charlotte, NC (US)

(72) Inventor: Christof Hammerschmidt, Wiesbaden (DE)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 16/311,759

(22) PCT Filed: Jul. 19, 2017

(86) PCT No.: PCT/US2017/042695
§ 371 (c)(1),
(2) Date: Dec. 20, 2018

(87) PCT Pub. No.: WO2018/017631
PCT Pub. Date: Jan. 25, 2018

(65) Prior Publication Data

US 2019/0329956 A1 Oct. 31, 2019

Related U.S. Application Data

(60) Provisional application No. 62/363,984, filed on Jul. 19, 2016.

(51) Int. Cl.
*B65D 81/07* (2006.01)
*B65B 5/02* (2006.01)
(Continued)

(52) U.S. Cl.
CPC ..... *B65D 81/07* (2013.01); *B65B 5/024* (2013.01); *B65B 5/04* (2013.01); *B65B 43/10* (2013.01); *B65D 5/2057* (2013.01)

(58) Field of Classification Search
CPC ..... B65D 81/07; B65D 81/075; B65D 81/05; B65D 5/2057
(Continued)

(56) References Cited

U.S. PATENT DOCUMENTS 4,852,743 A 8/1989 Ridgeway
4,923,065 A 5/1990 Ridgeway
(Continued)

FOREIGN PATENT DOCUMENTS

WO 2014032059 A1 2/2014

OTHER PUBLICATIONS

Written Opinion of the International Searching Authority in PCT/US2017/042695 dated Jan. 25, 2018.

*Primary Examiner* — Steven A. Reynolds
(74) *Attorney, Agent, or Firm* — Jon M. Isaacson

(57) ABSTRACT

A retention packaging system includes a frame (102), a sheet (108), and an attachment zone (170). The frame includes a first panel (106), a second panel (112), and a sheet panel (108). The frame is foldable to a first folded state where the frame forms a space having an opening with the sheet panel (108) foldably connected to the first panel (106). The sheet is attached to the frame across a portion of the sheet panel. The frame is foldable to a second folded state where an attachment end (158) of the sheet panel (108) is attached to the attachment zone (170) with the sheet spanning across of the opening. In the second folded state, one side of the attachment end (158) is attached to a portion of the attachment zone (170) on the second panel (112) and the other side of the attachment end (158) is attached to another portion of the attachment zone (170) on an attachment flap (142, 146) foldably connected to the second panel (112).

16 Claims, 12 Drawing Sheets

(51) Int. Cl.
*B65B 5/04* (2006.01)
*B65B 43/10* (2006.01)
*B65D 5/20* (2006.01)

(58) Field of Classification Search
USPC ..... 206/583
See application file for complete search history.

(56) References Cited

U.S. PATENT DOCUMENTS 5,056,665 A * 10/1991 Boecker ..... B65D 81/07 206/583
5,071,009 A 12/1991 Ridgeway
5,287,968 A 2/1994 Ridgeway
5,388,701 A 2/1995 Ridgeway
5,678,695 A 10/1997 Ridgeway et al.
5,694,744 A 12/1997 Jones
5,893,462 A 4/1999 Ridgeway
6,010,006 A 1/2000 Ridgeway et al.
6,073,761 A 6/2000 Jones
6,148,590 A 11/2000 Ridgeway et al.
6,148,591 A 11/2000 Ridgeway et al.
6,223,901 B1 * 5/2001 Lofgren ..... B65D 81/075 206/495
6,289,655 B1 9/2001 Ridgeway et al.
6,302,274 B1 10/2001 Ridgeway
6,311,844 B1 11/2001 Ridgeway et al.
7,000,774 B2 * 2/2006 Bryant ..... B65D 5/22 206/320
8,177,067 B2 * 5/2012 McDonald ..... B65D 5/5021 206/583
8,499,937 B2 * 8/2013 McDonald ..... B65D 5/5021 206/583
8,627,958 B2 * 1/2014 McDonald ..... B65D 5/22 206/583
2003/0213719 A1 11/2003 Mueller et al.
2004/0108239 A1 6/2004 McDonald et al.
2005/0011807 A1 1/2005 Dennison et al.
2010/0140333 A1 * 6/2010 McDonald ..... B65D 5/22 229/117.01
2016/0052691 A1 2/2016 Ridgeway
2018/0327164 A1 * 11/2018 Kiessner ..... B65D 81/075

* cited by examiner

RETENTION PACKAGING ASSEMBLY

BACKGROUND

The present disclosure is in the technical field of protective packaging. More particularly, the present disclosure is directed to retention packaging.

Protective packaging structures may be used to help protect a product during transport, for example, from physical shock, dust, and other contaminants. For example, a product may be enclosed in a box with additional packing materials (e.g., crumpled paper, air-filled plastic cushions, molded foam) to restrain the product movement inside the box and to cushion the product.

One type of packaging system is known as "retention packaging." In typical retention packaging, a product is retained between a sheet and a rigid backing frame, which is sometimes the frame to which the sheet is attached. Another type of packaging system is known as suspension packaging. In typical suspension packaging, the packaged product is suspended between two sheets each attached to opposing frames sized to fit within a corresponding box. Examples of retention and suspension packaging are described in more detail in U.S. Pat. Nos. 4,852,743; 4,923,065; 5,071,009; 5,287,968; 5,388,701; 5,678,695; 5,893,462; 6,010,006; 6,148,590; 6,148,591; 6,289,655; 6,302,274; and 6,311,844, and in U.S. patent application Ser. No. 14/782,208, each of which is incorporated herein in its entirety by reference.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, a retention packaging system includes a frame, a sheet, and an attachment zone. The frame includes a first panel, a second panel, and a sheet panel, where the frame is configured to be folded from an unfolded state to a first folded state and from the first folded state to a second folded state. The sheet is attached to the frame across at least a portion of the sheet panel. The attachment zone has a first portion located on the second panel and at a second portion located on at least one attachment flap foldably connected to the second panel. When the frame is in the first folded state, the frame forms a three-dimensional space having an opening with the first panel being one side of the three-dimensional space and the sheet panel is foldably connected to the first panel at a first side of the opening. When the frame is in the second folded state an attachment end of the sheet panel is attached to the attachment zone with a first side of the attachment end attached to the first portion of the attachment zone on the second panel and a second side of the attachment end attached to the second portion of the attachment zone on the at least one attachment flap, and the sheet spans from the first side of the opening to a second side of the opening.

In one example, when the frame is in the second folded state, the sheet is configured to hold an object at the opening. In another example, the frame is configured to be folded from the second folded state to a final folded state. In another example, when the frame is in the final folded state, the object is located between the sheet and a portion of the frame that is configured to bias the object toward the sheet. In another example, the frame includes a bottom panel that forms a bottom of the three-dimensional space and four panels that form four sides of the three-dimensional space. In another example, the four panels include the first panel, a first side panel, a back panel, and a second side panel. In another example, the second panel is rotatably connected to the back panel at the second side of the opening.

In another example, the at least one attachment flap includes a first attachment flap foldably connected to a first end of the second panel and a second attachment flap foldably connected to a second end of the second panel. In another example, the attachment zone extends continuously across portions of the first attachment flap, the second panel, and the second attachment flap. In another example, a first side flap is foldably connected to the first end of the second panel and configured to be rotated independently of the first attachment flap, and a second side flap is foldably connected to the second end of the second panel and configured to be rotated independently of the second attachment flap. In another example, when the frame is in a final folded state, a portion of the first side flap is located between the sheet and a first side of the three-dimensional space and a portion of the second side flap is located between the sheet and a second side of the three-dimensional space.

In another example, the sheet is attached to the sheet panel via a first attachment zone on the sheet panel and a second attachment zone on the first panel. In another example, the sheet panel includes a first flap and a second flap located between the first attachment zone on the sheet panel and the second attachment zone on the first panel. In another example, when the frame is in the second folded state, the first and second flaps are located over the opening. In another example, when the first and second flaps are located over the opening, the first and second flaps are configured to be rotated away from the sheet to expose a portion of the sheet and permit placement of an object on the exposed portion of the sheet. In another example, after the object has been placed on the sheet, the first and second flaps are configured to be rotated toward the sheet to bias the object toward the sheet. In another example, when the frame is in a final folded state, the second panel is configured to be over the first and second flaps and to bias the first and second flaps toward the object.

In another embodiment method of packaging an object using a retention packaging system is performed, where the retention packaging system includes a frame and a sheet attached to the frame. The method includes folding the frame from an unfolded state to a first folded state. In the first folded state, the frame forms a three-dimensional space with an opening, a first panel of the frame forms a side of the three-dimensional space, and a sheet panel of the frame is foldably connected to the first panel at a first side of the opening. The method also includes folding the frame from the first folded state to a second folded state. When the frame is in the second folded state, a second end of the sheet panel is attached to an attachment zone with a first side of the second end attached to a first portion of the attachment zone on a second panel of the frame and a second side of the second end attached to a second portion of the attachment zone on at least one attachment flap foldably connected to the second panel, and the sheet spans from the first side of the opening to a second side of the opening.

In one example, the method further includes placing an object on the sheet at the opening and folding the frame from the second folded state to a final folded state, where, when the frame is in the final folded state, the object is located between the sheet and a portion of the frame that is configured to bias the object toward the sheet. In another example, folding the frame from the second folded state to the final folded state causes the object to be biased toward the sheet such that the sheet deforms from a rest state. In another example, the method further includes retrieving the retention packaging system from a stack of retention packaging systems that are in the unfolded state before folding the frame from the unfolded state to the first folded state.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The present disclosure describes embodiments of retention packaging systems. While existing retention structures provide a level of protection for the packaged object, there is room for improvement. For example, existing retention structures are provided as inserts to a shipping box or other container. It may be advantageous to provide a retention packaging structure integrated with a shipping container. This reduces waste and expense of having two pieces (i.e., the retention insert and the shipping box). In addition, a shipping recipient may find disposal of a retention packaging structure integrated with the shipping container to be easier because there are fewer pieces to dispose of, particularly if the materials of the retention packaging structure and integrated shipping container are recyclable.

Figure 1A:
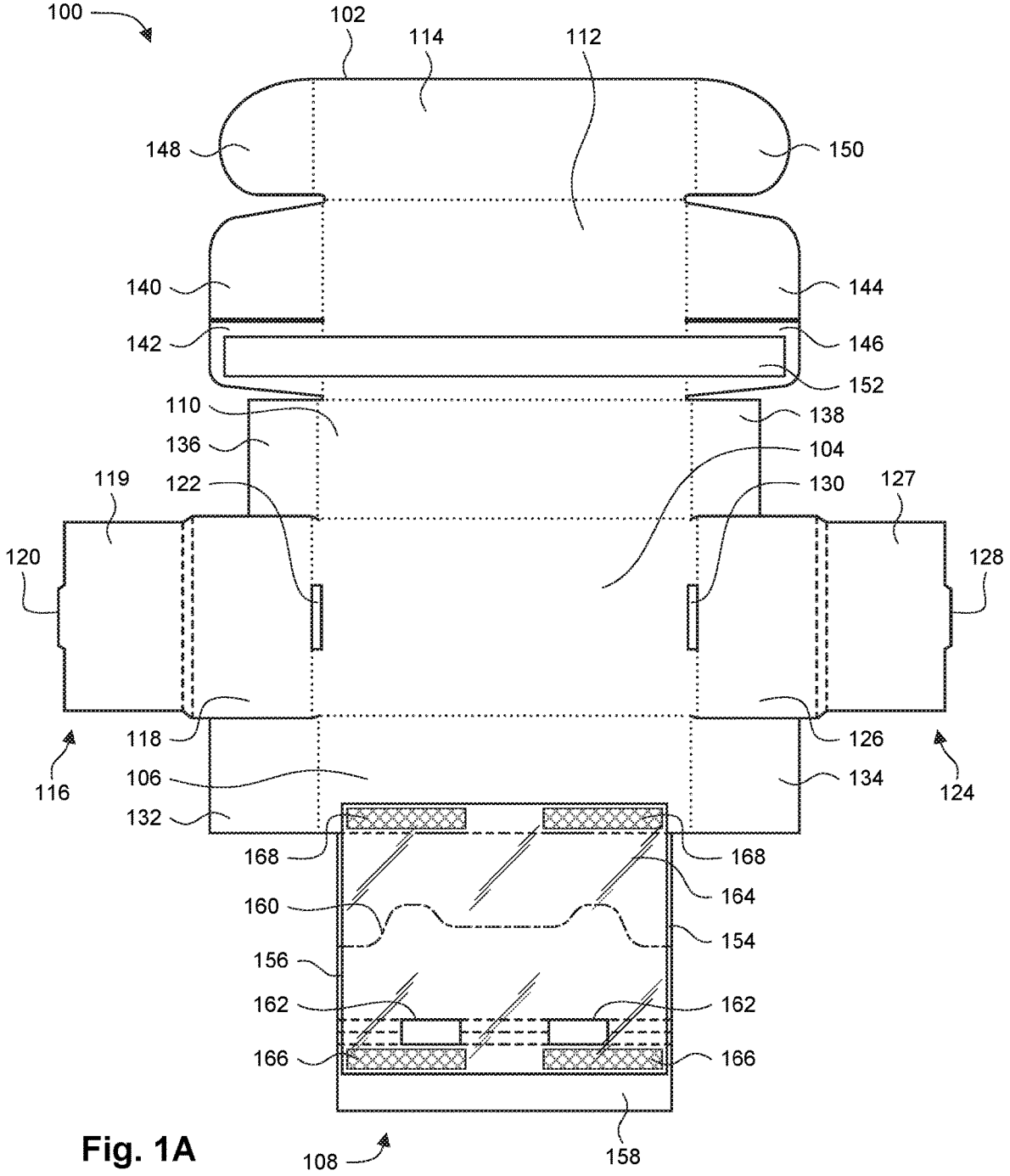
FIGS. 1A and 1B depict top and bottom views, respectively, of an embodiment of a retention package assembly, in accordance with the embodiments disclosed herein.
Figure 1B:
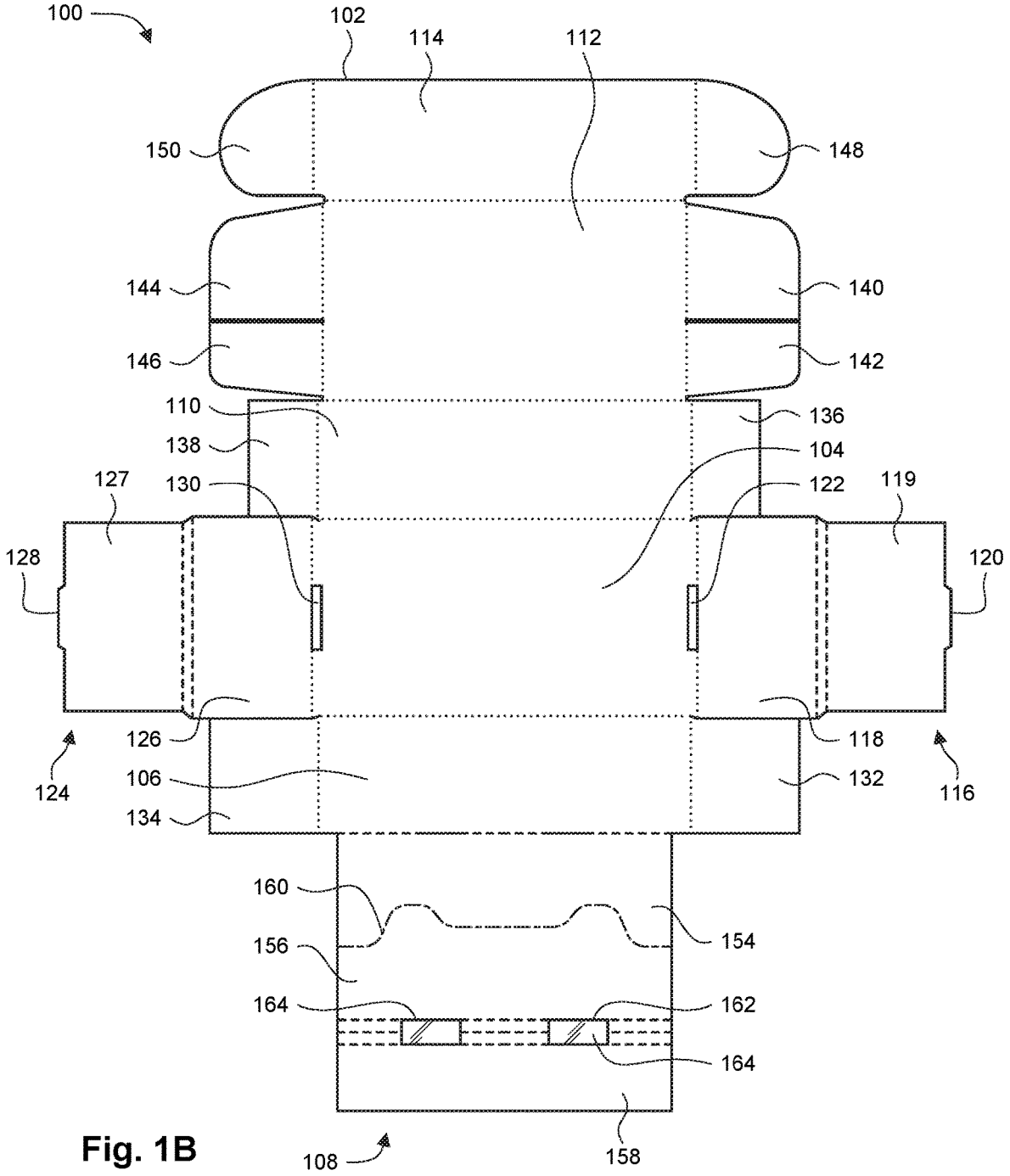

Depicted in FIGS. 1A and 1B are top and bottom views, respectively, of an embodiment of a retention package assembly 100. The retention package assembly 100 includes a frame 102. In some embodiments, the frame 102 or any portion thereof, comprises a substantially rigid, lightweight, foldable material. In some examples, frame 102, or any of the portions of frame 102 described herein, are formed of one or more of any of the following materials: cellulosic-based materials (e.g., cardboard, corrugated cardboard, paperboard), plastic, and compressed foam. In one example, frame 102 may comprise corrugated cardboard, such as any of single-wall B-flute, C-flute, and/or E-flute corrugated cardboard, B/C double-wall corrugated cardboard, E/B double-wall corrugated cardboard, or any combination thereof. In some embodiments, the frame 102 has a predetermined average thickness. In some examples, the average thickness of the frame 102, for example, at most about, and/or at least about, any of the following thicknesses: 0.03, 0.06, 0.12, 0.18, 0.25, 0.3, 0.4, and 0.5 inches.

The frame 102 is configured to be folded into a container, as shown in the instances from FIG. 2A to FIG. 9B. In the depicted embodiment, the frame 102 includes a bottom panel 104, a first front panel 106, a sheet panel 108, a back panel 110, a top panel 112, and a second front panel 114. A fold line is located between each of the bottom panel 104 and the first front panel 106, the first front panel 106 and the sheet panel 108, the bottom panel 104 and the back panel 110, the back panel 110 and the top panel 112, and the top panel 112 and the second front panel 114. A "fold line," as used herein, represents a line along which a panel, frame, or other material has been creased, crimped, embossed, perforated, scored, or otherwise weakened so as to enhance the foldability of the panel, frame, or other material along the fold line.

Fold lines are depicted in FIGS. 1A and 1B as dotted lines to represent creased lines, dashed lines to represent partially-perforated lines, long-short-long dashed lines to represent perforated lines, and solid lines to represent slits. For example, the bottom panel 104 is foldably connected to the first front panel 106 by a creased fold line. In another example, the first front panel 106 is foldably connected to the sheet panel 108 by a fold line that includes two slits in between three partially-perforated portions. In another example, the bottom panel 104 is foldably connected to the back panel 110 by a creased fold line. In another example, the back panel 110 is foldably connected to the top panel 112 by a creased fold line. In another example, the top panel 112 is foldably connected to the second front panel 114 by a creased fold line. While the fold lines depicted in FIGS. 1A and 1B are particular forms of fold lines, the depicted fold lines could be replaced with any other form of fold lines.

The bottom panel 104 is also foldably connected to a left side panel 116 by a creased fold line. The left side panel 116 includes a left side outer portion 118 and a left side inner portion 119. The left side outer portion 118 is foldably connected to the left side inner portion 119 by two fold lines that are partially-perforated fold lines. The left side panel 116 includes a left locking tab 120. The bottom panel 104 includes a left slot 122 configured to receive the left locking tab 120. In one embodiment, the left slot 122 is configured to receive the left locking tab 120 when the fold line between the bottom panel 104 and the left side panel 116 and the fold lines between the left side outer portion 118 and the left side inner portion 119 are folded at approximately 90° angles.

The bottom panel 104 is also foldably connected to a right side panel 124 by a creased fold line. The right side panel 124 includes a right side outer portion 126 and a right side inner portion 127. The right side outer portion 126 is foldably connected to the right side inner portion 127 by two fold lines that are partially-perforated fold lines. The right side panel 124 includes a right locking tab 128. The bottom panel 104 includes a right slot 130 configured to receive the right locking tab 128. In one embodiment, the right slot 130 is configured to receive the right locking tab 128 when the fold line between the bottom panel 104 and the right side panel 124 and the fold lines between the right side outer portion 126 and the right side inner portion 127 are folded at approximately 90° angles.

The first front panel 106 is foldably connected to a left first front flap 132 by a creased fold line. The first front panel 106 is also foldably connected to a right first front flap 134 by a creased fold line.

The back panel 110 is foldably connected to a left back flap 136 by a creased fold line. The back panel 110 is also foldably connected to a right back flap 138 by a creased fold line.

The top panel 112 is foldably connected to a left top flap 140 by a creased fold line. The top panel 112 is also foldably connected to a left attachment flap 142. In some embodiments, the left top flap 140 and the left attachment flap 142 are foldably connected to a first end of the top panel 112 (e.g., the left end as shown in FIG. 1A) and are capable of being folded with respect to the top panel 112 independently of each other. The top panel 112 is also foldably connected to a right top flap 144 by a creased fold line. The top panel 112 is also foldably connected to a right attachment flap 146. In some embodiments, the right top flap 144 and the right attachment flap 146 are foldably connected to a second end of the top panel 112 (e.g., the right end as shown in FIG. 1A) and are capable of being folded with respect to the top panel 112 independently of each other.

The second front panel 114 is foldably connected to a left second front flap 148 by a creased fold line. The second front panel 114 is also foldably connected to a right second front flap 150 by a creased fold line.

Depicted in FIG. 1A is a liner 152 located over an attachment zone (not visible in FIG. 1A). In the depicted embodiment, the liner 152 covers a first portion of the attachment zone located on the top panel 112 and a second portion of the attachment zone located on the left attachment flap 142 and the right attachment flap 146. In some examples, the attachment zone is a single continuous attachment zone that extends from the left attachment flap 142, to the top panel 112, and to the right attachment flap 146. In some embodiments, as discussed below, the liner 152 is capable of being removed to expose the adhesive zone to permit the adhesive zone to be adhered to the sheet panel 108.

The sheet panel 108 includes a front flap 154, a back flap 156, and an attachment end 158. The front flap 154 is located between a perforation line 160 and the fold line between the first front panel 106 and the sheet panel 108. The back flap 156 is located between the perforation line 160 and slots 162. The attachment end 158 is located on the end of the sheet panel 108 beyond the slots 162. In the depicted embodiment, three partially-perforated fold lines are located between the slots 162 and between each of the slots 162 and the sides of the sheet panel 108.

The retention packaging assembly 100 includes a sheet 164. In the depicted embodiment, the sheet 164 extends from the attachment end 158 of the sheet panel 108 to the first front panel 106. In the depicted embodiment, the sheet 164 is attached to the attachment end 158 of the sheet panel 108 by an attachment zone 166 and the sheet 164 is attached to the first front panel 106 by an attachment zone 168. In the depicted embodiment, the both of the attachment zones 166 and 168 include two distinct attachment zones such that one of the attachment zones 166 and 168 is located near the corners of the sheet 164. However, in other embodiments, the attachment zones 166 and 168 can include one single continuous attachment zone or any number of distinct attachment zones.

In some examples, the adhesive zones described herein (e.g., attachment zones 166 and 168 and the attachment zone under the liner 152) include an adhesive. However, in other embodiments, the attachment zones described herein are formed by attaching by one or more of any of the following: adhering (e.g., with hot melt adhesive), gluing, heat welding, ultrasonic welding, stapling, tacking, fastening, clipping (see, e.g., U.S. Pat. No. 5,694,744 to Jones, which is incorporated herein in its entirety by reference), tab/slot engagement (see, e.g., U.S. Pat. No. 6,073,761 to Jones, which is incorporated herein in its entirety by reference), anchoring, retaining and/or securing (see, e.g., U.S. Patent Application Publication 2004/0108239 A1 to McDonald et al. published Jun. 10, 2004, which is incorporated herein in its entirety by reference, and which discloses a sleeve having pockets or pouches for receiving a flap as shown in FIGS. 24-25 and related discussion therein). The sheets of any embodiments described herein may be attached by one or more of any of the attachment ways described herein. Useful types of adhesives for attaching sheets to frames are known to those of skill in the art, and of course depend on the composition of the materials to be adhered. For example, a polyurethane-based sheet may be adhered with a polyurethane-based adhesive, such as a water-borne aliphatic polyurethane dispersion.

The sheet 164, and any of the sheets of the various embodiments described herein, may comprise any of the materials, compositions, and polymers set forth herein with respect to sheets, and may have any thickness, properties, treatments, additives, and other characteristics (e.g., flexibility, elasticity, optics, strength, elastic recovery, transparency, load tear resistance, puncture resistance) as set forth herein with respect to sheets.

In some embodiments, the sheet 164 has a composition and thickness providing acceptable performance properties (e.g., flexibility, elasticity, optics, strength) for the given packaging application of expected use. In some examples, the sheet 164 has a thickness of at most any of the following: 10 mils, 6 mils, 5 mils, 4 mils, 3 mils, 2 mils, 1.5 mils, and 1 mil. (A "mil" is equal to 0.001 inch.) In some examples, the sheet 164 has a thickness of at least any of the following: 0.5 mils, 1 mil, 1.5 mils, 2 mils, and 3 mils.

In some embodiments, the sheet 164 has an elastic recovery in either or both of the transverse and longitudinal directions of at least any of the following values: 60%, 65%, 70%, 75%, 80%, and 85%, measured according to ASTM D5459 at 100% strain, 30 seconds relaxation time, and 60 second recovery time.

In some embodiments, the sheet 164 has a maximum load tear resistance in either or both of the transverse and longitudinal directions of at least any of the following values: 400, 450, 500, 550, and 600 grams force, measured according to ASTM D1004.

In some embodiments, the sheet 164 has a slow puncture maximum load of at least any of the following values: 4, 4.5, 5, 5.5, 6, 6.5, and 7 pounds force, measured according to ASTM F1306 using a crosshead speed of 5 inches per minute.

In some embodiments, the sheet 164 has a Young's modulus sufficient to withstand the expected handling and use conditions, yet may provide a "soft" feel that may be desirable for a packaging application. The sheet may have a Young's modulus of at least any of the following values: 2,000; 2,500; 3,000; 3,500; and 4,000 pounds/square inch. The sheet may have a Young's modulus of no more than about any of the following values: 8,000; 10,000; 15,000; 20,000; 30,000; and 40,000 pounds/square inch. The Young's modulus is measured in accordance with ASTM D882, measured at a temperature of 73° F.

In some embodiments, the sheet 164 is transparent so that a packaged article is visible through the sheet. As used herein, "transparent" means that the material transmits incident light with negligible scattering and little absorption, enabling objects to be seen clearly through the material under typical unaided viewing conditions (i.e., the expected use conditions of the material). The transparency (i.e., clarity) of the retention sheet may be at least any of the following values: 65%, 70%, 75%, 80%, 85%, and 90%, measured in accordance with ASTM D1746.

In some embodiments, the sheet 164 has a heat-shrink attribute. In some examples, the sheet 164 has any of a free shrink in at least one direction (i.e., machine or transverse directions), in each of at least two directions (i.e., machine and transverse directions), measured at any of 160° F. and 180° F. of at least any of the following: 7%, 10%, 15%, 20%, 25%, 30%, 40%, 50%, 55%, 60% and 65%. In other embodiments, the sheet 164 is non-heat shrinkable (i.e., has a total free shrink of less than 5% measured at 160° F.). Unless otherwise indicated, each reference to free shrink in this application means a free shrink determined by measuring the percent dimensional change in a 10 cm×10 cm specimen when subjected to selected heat (i.e., at a certain temperature exposure) according to ASTM D 2732.

In some embodiments, the sheet 164 includes one or more fabrics. For example, in some embodiments, the sheet 164 includes one or more of the following: wovens, knits, nonwovens, and openwork meshes (e.g., netting), spandex, including Lycra®brand spandex, and elastic fabrics.

In some embodiments, the sheet 164 includes one or more polymers. In some examples, the sheet 164 includes one or more of any of the following polymers: thermoplastic polymers, polyolefins, polyethylene homopolymers (e.g., low density polyethylene), polyethylene copolymers (e.g., ethylene/alpha-olefin copolymers ("EAOs"), ethylene/unsaturated ester copolymers, and ethylene/(meth)acrylic acid), polypropylene homopolymers, polypropylene copolymers, polyvinyl chloride, various types of natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), and polyurethane (i.e., any one or more of polyurethane, polyether polyurethane, polyester polyurethane, and polycarbonate polyurethane, any of which may be aliphatic and/or aromatic). In some embodiments, the sheet 164 includes thermoplastic polyolefin elastomers (TPOs), which are two-component elastomer systems comprising an elastomer (such as EPDM) finely dispersed in a thermoplastic polyolefin (such as polypropylene or polyethylene). As used in this application, "copolymer" means a polymer derived from two or more types of monomers, and includes terpolymers, etc.

In some embodiments, the sheet 164 includes polyolefin (e.g., polyethylene), polyvinyl chloride, and/or polyurethane. In some examples, such embodiments of the sheet 164 have a thickness of from 2 to 4 mils. Such embodiments of the sheet 164 may be useful for lightweight applications. In some examples, the sheet 164 including polyurethane may provide desirable elastomeric, puncture resistance, temperature resistance, and tackiness characteristics.

In some embodiments, the sheet 164 includes effective amounts of one or more of tackifiers, antiblocking agents, and slip agents—or may be essentially free of any of these components. Tackifiers, antiblocking agents, and slip agents, and their effective amounts, are known to those of ordinary skill in the art.

In some embodiments, the sheet 164 is manufactured by thermoplastic film-forming processes known in the art (e.g., tubular or blown-film extrusion, coextrusion, extrusion coating, flat or cast film extrusion). In some embodiments, a combination of these processes is also employed to manufacture the sheet 164.

In some embodiments, at least one side of the sheet 164 is corona and/or plasma treated to change the surface energy of the sheet 164. In one example, the change in surface energy increases the ability of the sheet 164 to adhere to a panel or frame.

Films that may be useful as sheets (e.g., sheet 164) are described in U.S. Pat. No. 6,913,147, issued Jul. 5, 2005, and entitled "Packaging Structure Having a Frame and Film," which is incorporated herein in its entirety by reference.

By using types of machinery well known to those of skill in the field, frame 102 may be cut to the desired shapes and provided with fold lines or lines of detachability, using the known types of machinery, for example, to slit, crease, crimp, emboss, perforate, scored, or otherwise weaken the panel in desired regions. In some embodiments, attachment zones are applied to the frame 102 in selected areas, for example, the attachment zones 166 and 168 shown in FIG. 1A. In some embodiments, the sheet 164 is attached to the frame 102 by laminating or adhering the sheet 164 with adhesive to the frame 102. In some embodiments, the material of the sheet 164 is provided in roll form or unrolled form, and then cut to the desired length and width either before or after attachment to the frame 102.

In some embodiments, the retention packaging assembly 100 is provided in an unfolded (or "lay-flat") configuration, such as in the configuration shown in FIGS. 1A and 1B. The bottom panel 104, the first front panel 106, the sheet panel 108, the back panel 110, the top panel 112, the second front panel 114, and their associated flaps are each in an unfolded position, with each being generally coplanar with the bottom panel 104. Further, the perforation line 160 between the front and back flaps 154 and 156 of the sheet panel 108 is not yet broken. Such configurations may facilitate the provision of multiple retention packing assemblies in a convenient stacked or bundled arrangement (not illustrated). In some embodiments, the retention packaging assembly 100 is retrieved from a stack of retention packaging assemblies that are in an unfolded state before folding the retention packaging assembly 100.

Figure 8A:
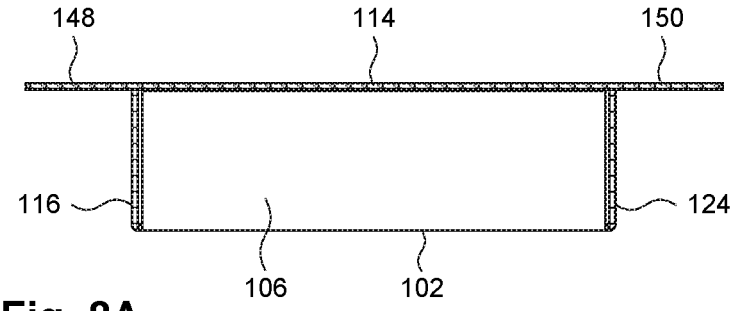
FIGS. 8A and 8B depict, respectively, front and top views of a sixth folded state the retention packaging assembly depicted in FIGS. 1A and 1B, in accordance with the embodiments disclosed herein.
Figure 8B:
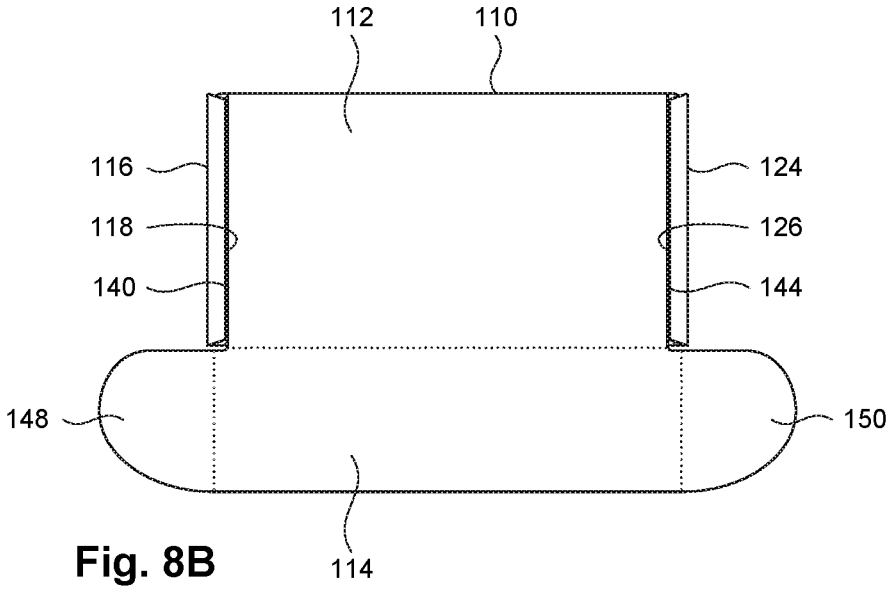
Figure 9A:
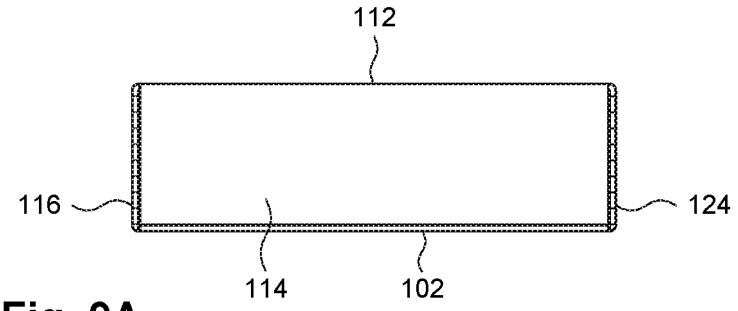
FIGS. 9A and 9B depict, respectively, front and top views of a final folded state the retention packaging assembly depicted in FIGS. 1A and 1B, in accordance with the embodiments disclosed herein.
Figure 9B:
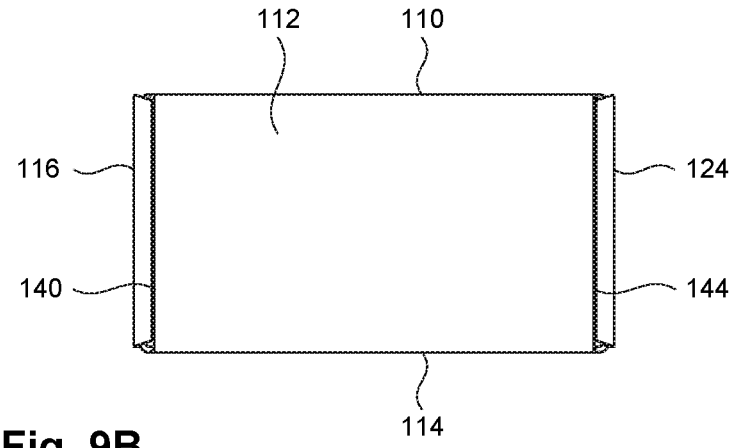

As noted above, the frame 102 is configured to be folded from the generally coplanar state shown in FIGS. 1A and 1B into a package, such as the package shown in FIGS. 9A and 9B. An embodiment of a method of folding the retention packaging assembly 100 into a package with an object retained inside is depicted in a number of instances shown in FIG. 2A to FIG. 9B. While the embodiment of the method is depicted using the retention packaging assembly 100, other embodiments of retention packaging assemblies may be used to form a package with an object retained inside. Similarly, the method described with respect to FIG. 2A to FIG. 9B may be altered or modified while still obtaining a package with an object retained inside from a retention packaging assembly.

In one embodiment, the frame 102 is folded from an unfolded state (e.g., the generally coplanar state shown FIGS. 1A and 1B) to a first folded state shown in FIGS. 2A to 2D. FIGS. 2A to 2D depict, respectively, front, top, back sectional, and front sectional views of the retention packaging assembly 100 in the first folded state.

In one example of folding the frame 102 from the unfolded state to the first folded state, the left first front flap 132 is rotated to a vertical orientation about the fold line between the first front panel 106 and the left first front flap 132. Similarly, the right first front flap 134 is rotated to a vertical orientation about the fold line between the first front panel 106 and the right first front flap 134. The first front panel 106 is then rotated to a vertical orientation about the fold line between the bottom panel 104 and the first front panel 106, causing the left first front flap 132 to be oriented vertically and parallel to the fold line between the bottom panel 104 and the left side panel 116 and causing the right first front flap 134 to be oriented vertically and parallel to the fold line between the bottom panel 104 and the right side panel 124.

In another example of folding the frame 102 from the unfolded state to the first folded state, the left back flap 136 is rotated to a vertical orientation about the fold line between the back panel 110 and the left back flap 136. Similarly, the right back flap 138 is rotated to a vertical orientation about the fold line between the back panel 110 and the right back flap 138. The back panel 110 is then rotated to a vertical orientation about the fold line between the bottom panel 104 and the back panel 110, causing the left back flap 136 to be oriented vertically and parallel to the fold line between the bottom panel 104 and the left side panel 116 and causing the right back flap 138 to be oriented vertically and parallel to the fold line between the bottom panel 104 and the right side panel 124.

In another example of folding the frame 102 from the unfolded state to the first folded state, the left side panel 116 is rotated to an upward vertical orientation about the fold line between the bottom panel 104 and the left side panel 116. The left side inner portion 119 is then rotated down to a horizontal orientation and then to a downward vertical orientation about the two fold lines between the left side outer portion 118 and the left side inner portion 119 until the left locking tab 120 engages the left slot 122. In this position, the vertically-oriented left first front flap 132 and left back flap 136 are positioned between the left side outer portion 118 and the left side inner portion 119 of the left side panel 116. Similarly, the right side panel 124 is rotated to an upward vertical orientation about the fold line between the bottom panel 104 and the right side panel 124. The right side inner portion 127 is then rotated down to a horizontal orientation and then to a downward vertical orientation about the two fold lines between the right side outer portion 126 and the right side inner portion 127 until the right locking tab 128 engages the right slot 130. In this position, the vertically-oriented right first front flap 134 and right back flap 138 are positioned between the right side outer portion 126 and the right side inner portion 127 of the right side panel 124.

Figure 2A:
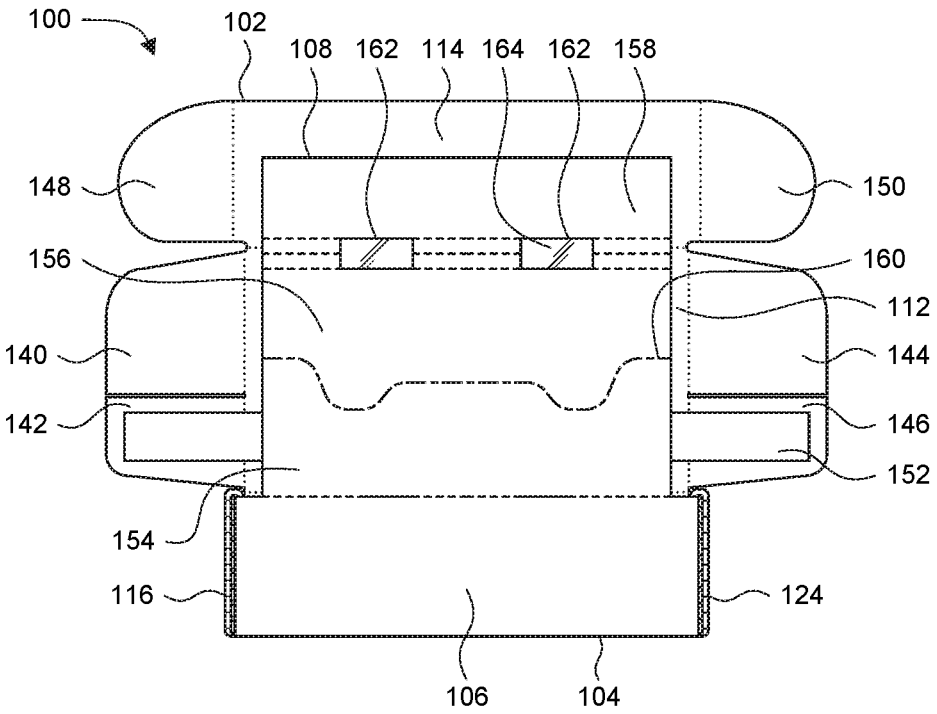
FIGS. 2A, 2B, 2C, and 2D depict, respectively, front, top, back sectional, and front sectional views of a first folded state of the retention packaging assembly depicted in FIGS. 1A and 1B, in accordance with the embodiments disclosed herein.
Figure 2B:
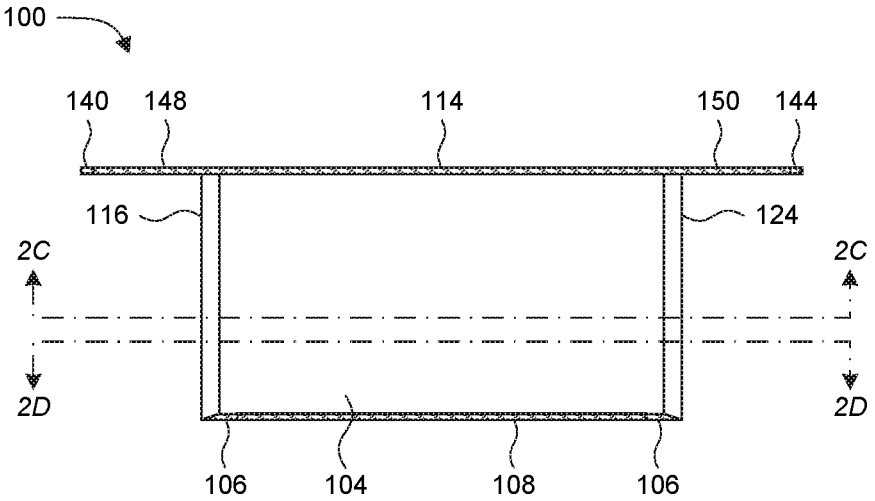

In the first folded state depicted in FIGS. 2A to 2D, the frame 102 forms a three-dimensional space with four panels (i.e., the first front panel 106, the left side outer portion 118, the back panel 110, and the right side outer portion 126) that extend upward from the bottom panel 104 to form an opening. The opening of the container is formed at the tops of the four panels that extend upward from the bottom panel 104. As shown in FIG. 2B, the top view looks down through the opening to the bottom panel 104 with the first front panel 106, the left side outer portion 118, the back panel 110, and the right side outer portion 126 around the three-dimensional space.

Figure 2C:
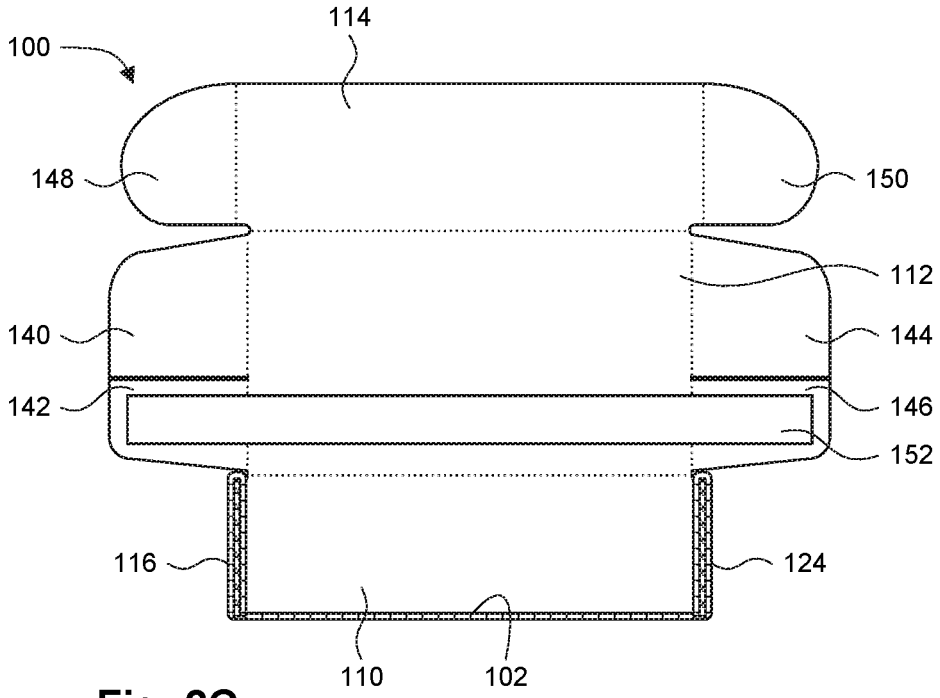
Figure 2D:
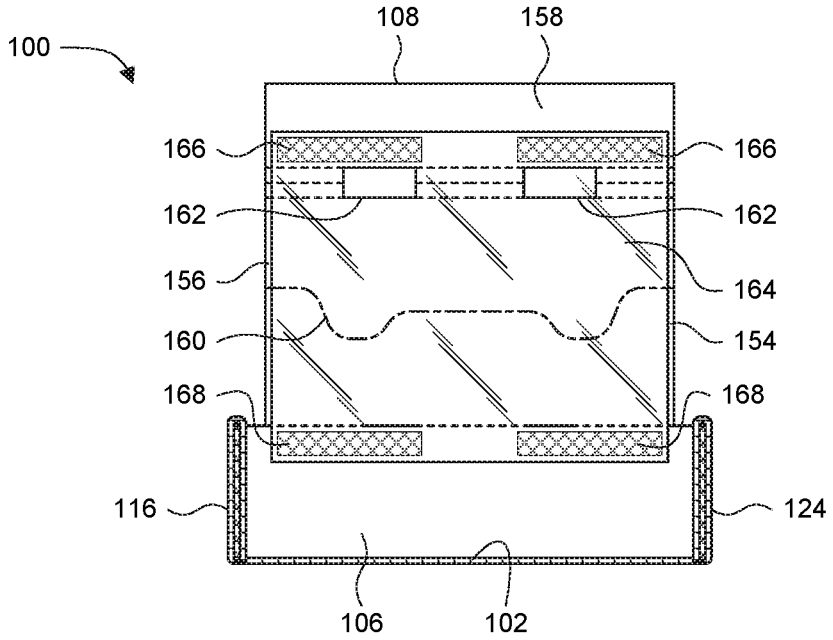

In the embodiment of the first folded state depicted in FIGS. 2A, 2B, and 2D, the sheet panel 108 is in a substantially vertical position extending upward from the first front panel 106. Similarly, the top panel 112 and the second front panel 114 are in a substantially vertical position extending upward from the back panel 110, as shown in FIGS. 2A, 2B, and 2C. As can be seen in FIG. 2D, the sheet 164 is located on the side of the sheet panel 108 that faces the opening of the container. As can be seen in FIG. 2C, the liner 152 is located on the side of the top panel 112 that faces the opening of the container.

Figure 3A:
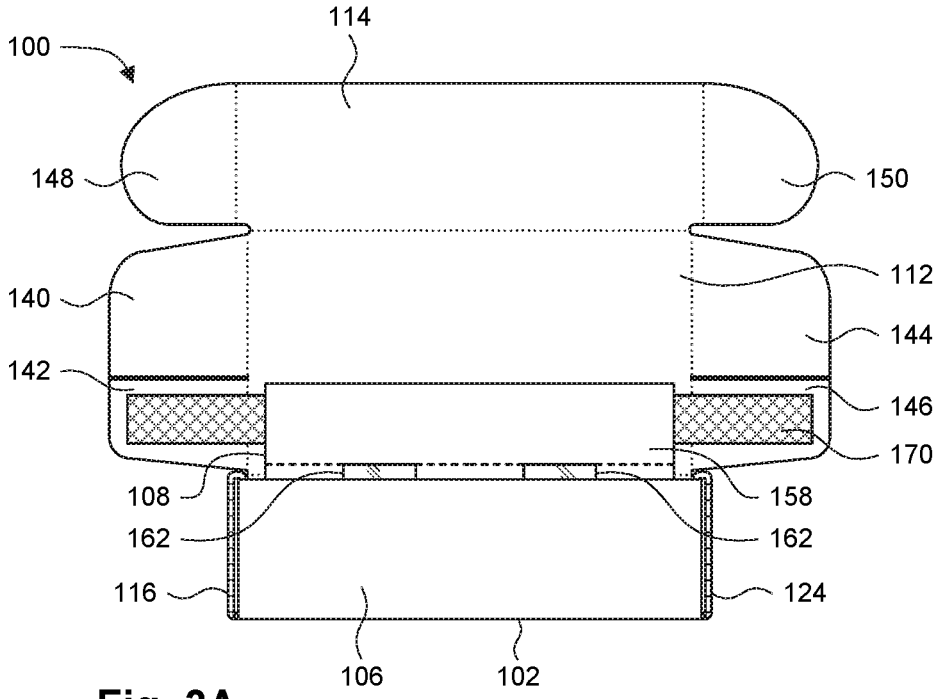
FIGS. 3A and 3B depict, respectively, front and top views of a second folded state the retention packaging assembly depicted in FIGS. 1A and 1B, in accordance with the embodiments disclosed herein.
Figure 3B:
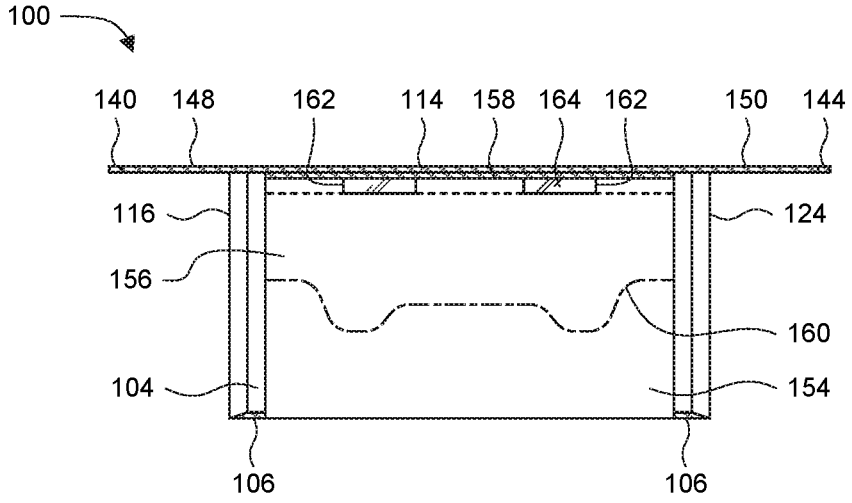

In another embodiment, the frame 102 is folded from the first folded state shown in FIGS. 2A to 2D to a second folded state shown in FIGS. 3A and 3B. FIGS. 3A and 3B depict, respectively, front and top views of the retention packaging assembly 100 in the second folded state.

In one example of folding the frame 102 from the first folded state to the second folded state, the sheet panel 108 is rotated down to horizontal orientation about the fold line between the first front panel 106 and the sheet panel 108. In another example, the attachment end 158 is folded upward vertically about one of the fold lines that extend from and between the slots 162. In this orientation, the attachment end 158 is located parallel to and against the top panel 112. In addition, as can be seen in FIG. 3B, the front flap 154 and the back flap 156 are located over the opening in the container. The sheet 164 is located over the opening and spans from one side of the opening (e.g., from the end of the opening at the top of the first front panel 106) to another side of the opening (e.g., to the end of the opening at the top of the back panel 110), even though the sheet 164 does not completely cover the opening.

As can be seen in FIG. 3A, the liner 152 has been removed to expose an attachment zone 170. In the depicted embodiment, the attachment zone 170 is a single attachment zone that is located in part on the top panel 112. However, in other embodiments, the attachment zone 170 can include multiple distinct attachment zones (i.e., any number of attachment zones greater than one). When the attachment end 158 is pressed against the exposed attachment zone 170, the attachment zone 170 attaches the attachment end 158 to the top panel 112. In one embodiment, the attachment zone 170 includes an adhesive. In other embodiments, the attachment zone 170 attaches the attachment end 158 to the top panel 112 using one or more of any of the following: adhering, gluing, heat welding, ultrasonic welding, stapling, tacking, fastening, clipping, tab/slot engaging, anchoring, retaining, or securing. In one embodiment, at least a portion of the sheet 164 that is attached to the attachment end 158 is also in contact with and attached to the attachment zone 170. In this way, the sheet 164 is also attached to the top panel 112. As can be seen in the embodiment depicted in FIG. 3A, the attachment end 158 does not cover the entire attachment zone 170. Portions of the attachment zone 170 extend beyond the left side of the attachment end 158 to the left attachment flap 142 and beyond the right side of the attachment end 158 to the right attachment flap 146.

Figure 4A:
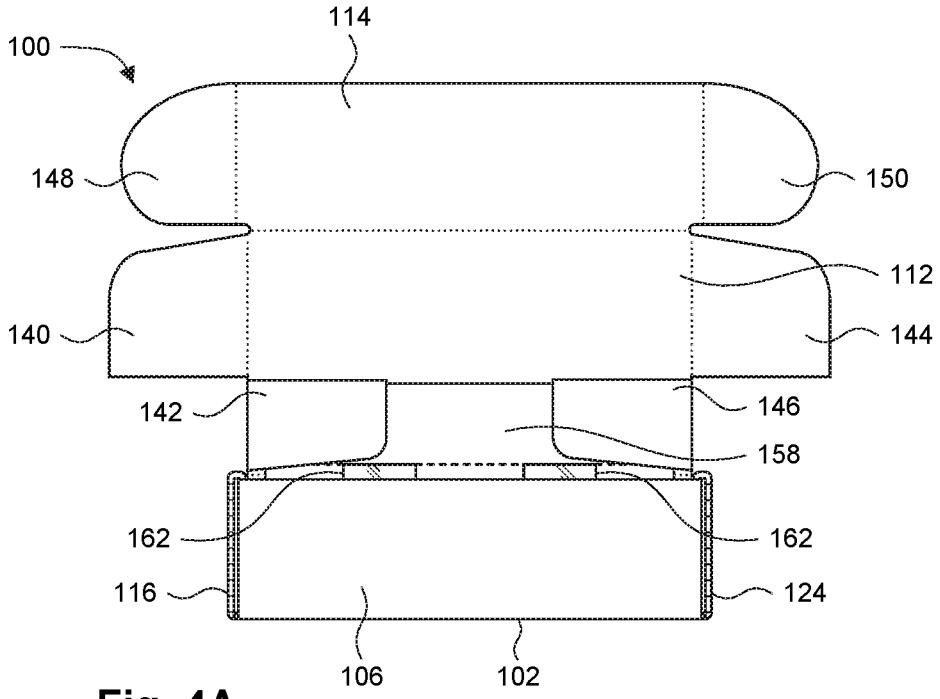
FIGS. 4A and 4B depict, respectively, front and top views of a third folded state the retention packaging assembly depicted in FIGS. 1A and 1B, in accordance with the embodiments disclosed herein.
Figure 4B:
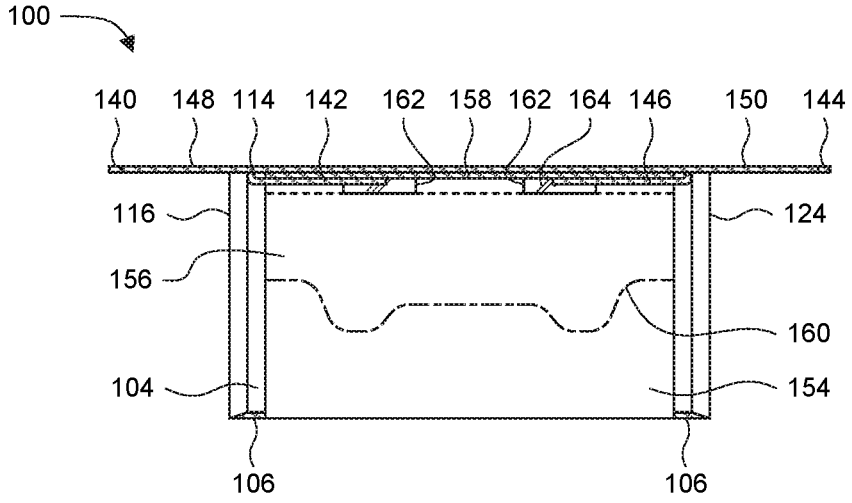

In another embodiment, the frame 102 is folded from the second folded state shown in FIGS. 3A and 3B to a third folded state shown in FIGS. 4A and 4B. FIGS. 4A and 4B depict, respectively, front and top views of the retention packaging assembly 100 in the third folded state.

In one example of folding the frame 102 from the second folded state to the third folded state, the left attachment flap 142 is rotated about the fold line between the top panel 112 and the left attachment flap 142. The left attachment flap 142 is rotated until the portion of the attachment zone 170 on the left attachment flap 142 attaches to the side of the attachment end 158 visible in FIGS. 3A and 4A. In another example, the right attachment flap 146 is rotated about the fold line between the top panel 112 and the right attachment flap 146. The right attachment flap 146 is rotated until the portion of the attachment zone 170 on the right attachment flap 146 attaches to the side of the attachment end 158 visible in FIGS. 3A and 4A. In this embodiment, one side of the attachment end 158 is attached to the top panel 112 and the other side of the attachment end 158 is attached to the left and right attachment flaps 142 and 146. The two-sided attachment of the attachment end 158 reduces the possibility of the attachment end 158 being pulled or ripped away from the top panel 112 and the left and right attachment flaps 142 and 146.

Figure 5A:
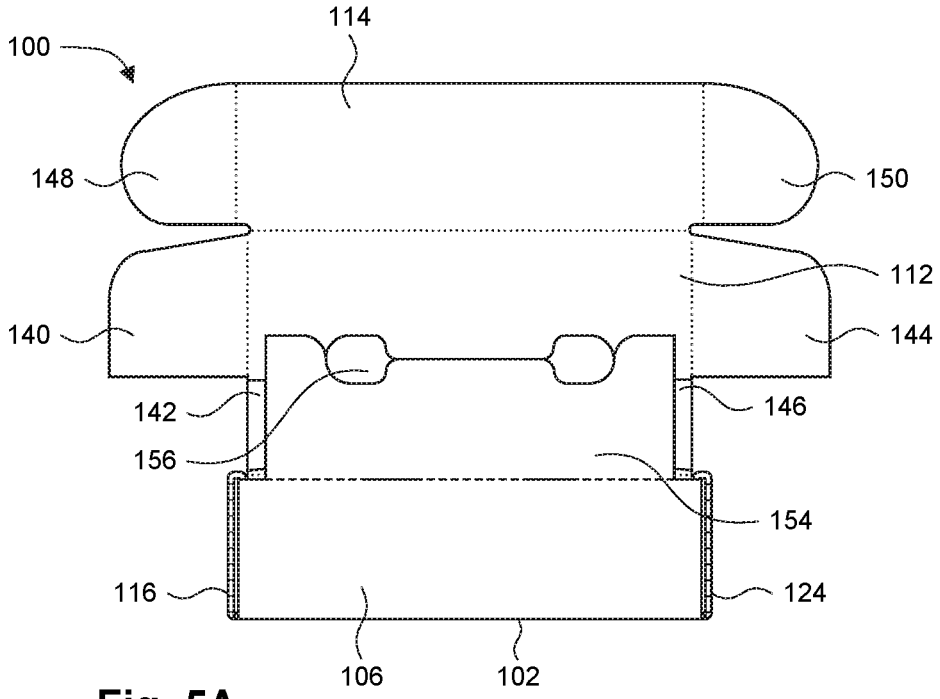
FIGS. 5A and 5B depict, respectively, front and top views of a fourth folded state the retention packaging assembly depicted in FIGS. 1A and 1B, in accordance with the embodiments disclosed herein.
Figure 5B:
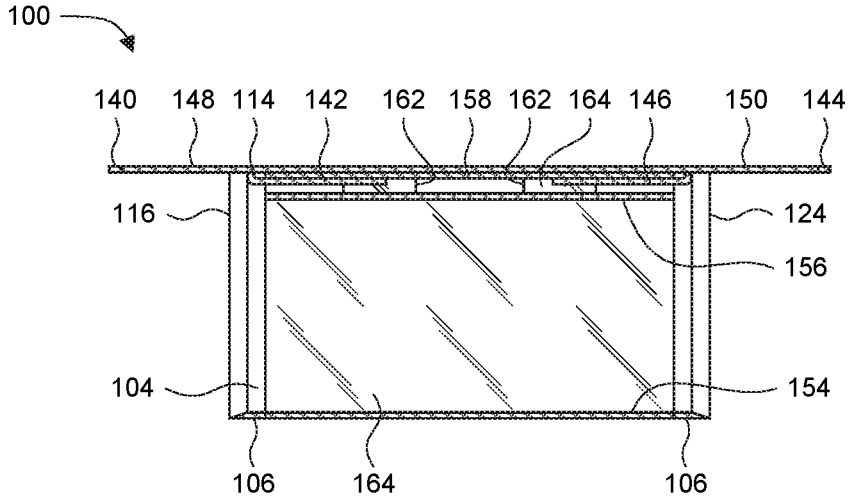

In another embodiment, the frame 102 is folded from the third folded state shown in FIGS. 4A and 4B to a fourth folded state shown in FIGS. 5A and 5B. FIGS. 5A and 5B depict, respectively, front and top views of the retention packaging assembly 100 in the fourth folded state.

In one example of folding the frame 102 from the third folded state to the fourth folded state, the front flap 154 is separated from the back flap 156 by breaking the perforation line 160. In some embodiments, the perforation line 160 is perforated such that a user is capable of breaking the perforation line 160 by pulling the front and back flaps 154 and 156 away from each other by hand. After the perforation line 160 is broken, the front flap 154 remains attached to the first front panel 106 and the back flap 156 remains attached to the top panel 112 via the attachment end 158 and the attachment zone 170.

In another example of folding the frame 102 from the third folded state to the fourth folded state, the front flap 154 is rotated upward to a vertical orientation about the fold line between the first front panel 106 and the front flap 154, as shown in FIG. 5A. Similarly, the back flap 156 is rotated upward to a vertical orientation about one of the fold lines that extend from the slots 162, as shown in FIG. 5A. These orientations of the front and back flaps 154 and 156 expose a portion of the sheet 164 located over the opening of the package, as shown in FIG. 5B. In some embodiments, the sheet 164 is held taught by the attachment zones 168 on the first front panel 106 on one side and by the attachment zones 166 on the attachment end 158 and the attachment zone 170 on the top panel 112 on the other side. In this orientation, the sheet 164 is configured to hold an object at the opening of the container.

Figure 6A:
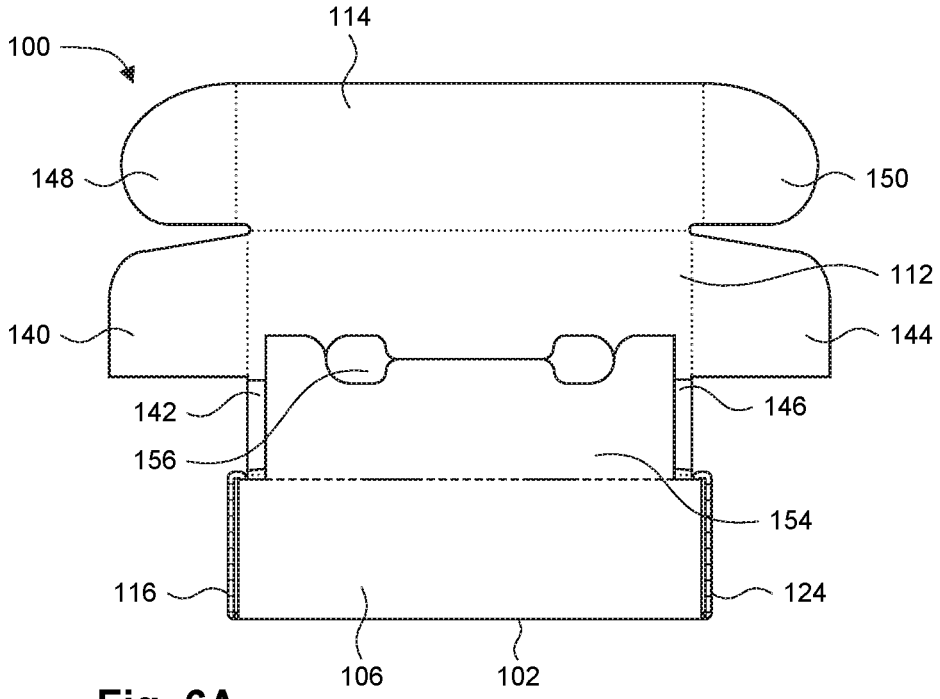
FIGS. 6A and 6B depict an embodiment of placing an object in the retention packaging assembly depicted in FIGS. 1A and 1B while the retention packaging assembly is in the fourth folded state, in accordance with the embodiments disclosed herein.
Figure 6B:
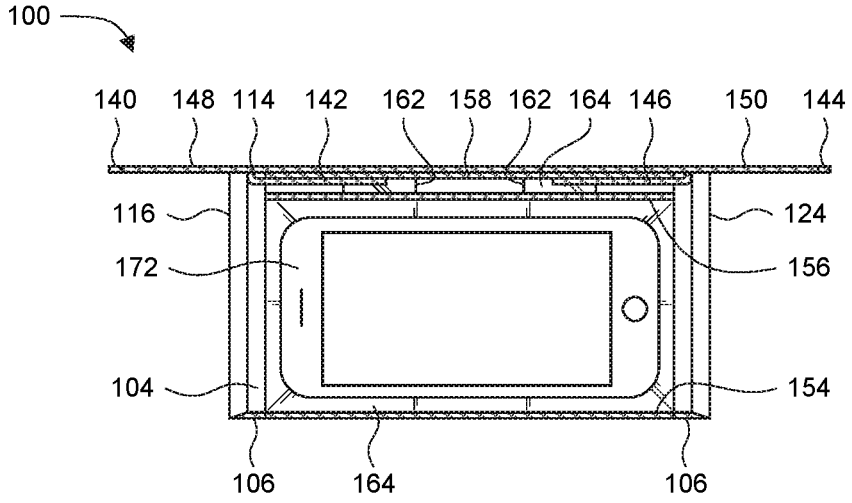

Depicted in FIGS. 6A and 6B is an embodiment of placing an object 172 in the retention packaging assembly 100 while the frame 102 is in the fourth folded state. The object 172 is placed on the exposed portion of the sheet 164, which holds the object 172 at the opening of the container. The position of the front and back flaps 154 and 156 permit placement of the object 172 on the exposed portion of the sheet 164. In the depicted embodiment, the object 172 is a cell phone; however, the object 172 may be any other object that fits within the opening of the package.

Figure 7A:
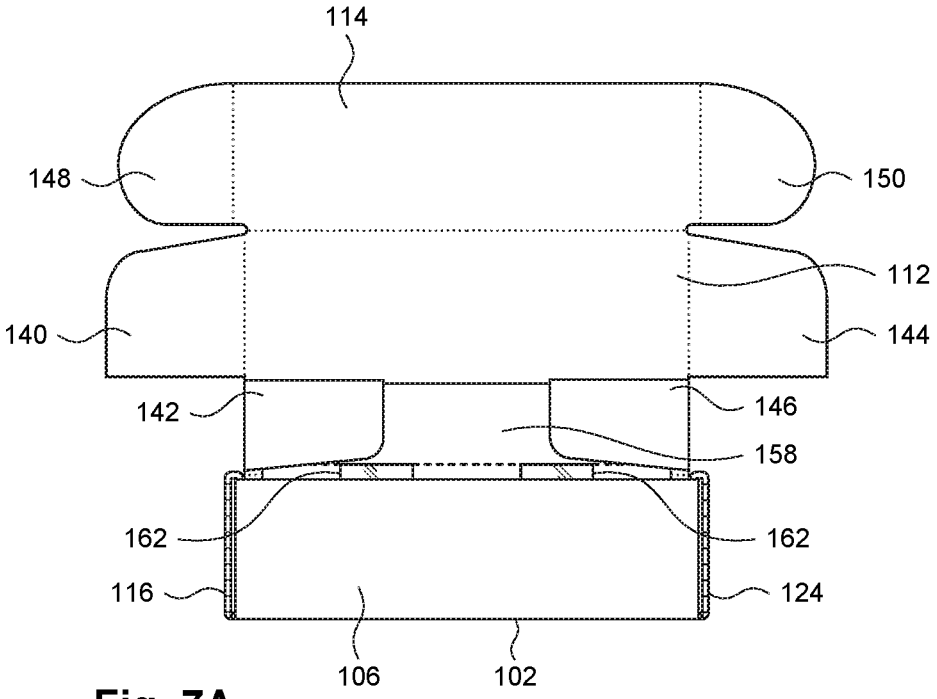
FIGS. 7A and 7B depict, respectively, front and top views of a fifth folded state the retention packaging assembly depicted in FIGS. 1A and 1B, in accordance with the embodiments disclosed herein.
Figure 7B:
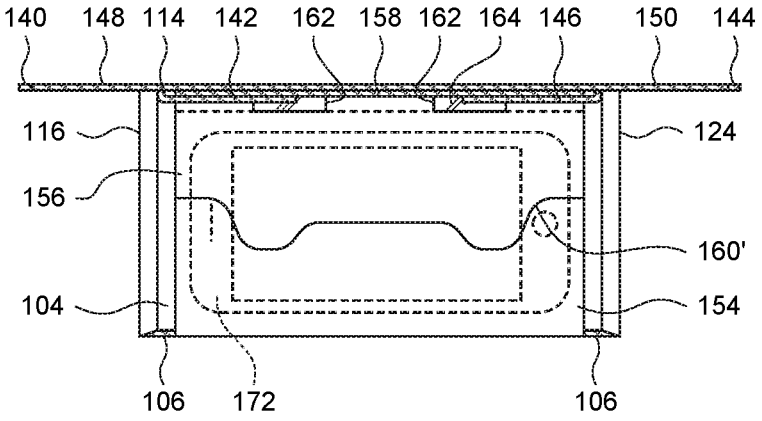

In another embodiment, the frame 102 is folded from the fourth folded state shown in FIGS. 6A and 6B to a fifth folded state shown in FIGS. 7A and 7B. FIGS. 7A and 7B depict, respectively, front and top views of the retention packaging assembly 100 in the fifth folded state.

In one example of folding the frame 102 from the fourth folded state to the fifth folded state, the front flap 154 is rotated downward toward the object 172 about the fold line between the first front panel 106 and the front flap 154, as shown in FIG. 7B. Similarly, the back flap 156 is rotated downward toward the object 172 about one of the fold lines that extend from the slots 162, as shown in FIG. 7B. Due to the size of the object 172, the front and back flaps 154 and 156 may not come to rest in a horizontal orientation. As can be seen in FIG. 7B, the object 172 is located between the sheet 164 and the front and back flaps 154 and 156. As the front and back flaps 154 and 156 are rotated toward the object 172, the object 172 is forced downward such that the object 172 is retained between the sheet 164 and the front and back flaps 154 and 156. In some embodiments, the object 172 is forced downward such that the sheet 164 deforms or stretches from its rest state to accommodate the object 172.

In another embodiment, the frame 102 is folded from the fifth folded state shown in FIGS. 7A and 7B to a sixth folded state shown in FIGS. 8A and 8B. FIGS. 8A and 8B depict, respectively, front and top views of the retention packaging assembly 100 in the sixth folded state.

In one example of folding the frame 102 from the fifth folded state to the sixth folded state, the left top flap 140 is rotated forward about the fold line between the top panel 112 and the left top flap 140. In some embodiments, the left top flap 140 is rotated forward until the left top flap 140 is substantially perpendicular to the top panel 112. In another example, the right top flap 144 is rotated forward about the fold line between the top panel 112 and the right top flap 144. In some embodiments, the right top flap 144 is rotated forward until the right top flap 144 is substantially perpendicular to the top panel 112.

In another example of folding the frame 102 from the fifth folded state to the sixth folded state, the top panel 112 is rotated forward about the fold line between the back panel 110 and the top panel 112. The top panel 112 is rotated forward until the top panel 112 is substantially covering the opening of the package and the top panel 112 is substantially horizontal. In some embodiments, a user will ensure that the front and back flaps 154 and 156 are positioned properly as the top panel 112 is rotated forward such that the top panel 112 biases the front and back flaps 154 and 156 to a horizontal position as the top panel 112 is brought to a horizontal position. In some embodiments, the biasing of the front and back flaps 154 and 156 by the top panel 112 causes the object 172 to be biased toward the sheet 164 such that the sheet 164 is deformed from its rest state. This further secures the object 172 in its retained position between the sheet 164 and the front and back flaps 154 and 156. In addition, as the top panel 112 is rotated forward, the left and right top flaps 140 and 144 are guided such that the left top flap 140 passes through the gap between the sheet 164 and the left side panel 116 and the right top flap 144 passes through the gap between the sheet 164 and the right side panel 124.

In another embodiment, the frame 102 is folded from the sixth folded state shown in FIGS. 8A and 8B to a final folded state shown in FIGS. 9A and 9B. FIGS. 9A and 9B depict, respectively, front and top views of the retention packaging assembly 100 in the final folded state.

In one example of folding the frame 102 from the sixth folded state to the final folded state, the left second front flap 148 is rotated downward from the position shown in FIG. 8A about the fold line between the second front panel 114 and the left second front flap 148. In some embodiments, the left second front flap 148 is rotated downward until the left second front flap 148 is substantially perpendicular to the second front panel 114. In another example, the right second front flap 150 is rotated downward from the position shown in FIG. 8A about the fold line between the second front panel 114 and the right second front flap 150. In some embodiments, the right second front flap 150 is rotated downward until the right second front flap 150 is substantially perpendicular to the second front panel 114.

In another example of folding the frame 102 from the sixth folded state to the final folded state, the second front panel 114 is rotated downward from the position shown in FIG. 8A about the fold line between the top panel 112 and the second front panel 114. The second front panel 114 is rotated downward until the second front panel 114 reaches the first front panel 106. In some embodiments, as the second front panel 114 is rotated downward, the left and right second front flaps 148 and 150 are guided such that the left second front flap 148 passes through the gap between the left side outer portion 118 and the left side inner portion 119 of the left side panel 116 and the right second front flap 150 passes through the gap between the right side outer portion 126 and the right side inner portion 127 of the right side panel 124. This positioning of the left and right second front flaps 148 and 150 aids in preventing the container from being opened unintentionally.

In the final folded state shown in FIGS. 9A and 9B, the retention packaging assembly 100 has been folded into the container in a closed configuration and the object 172 is securely retained within the container. In this state, the retention packaging assembly 100 can be used to transport the object 172, such as mailing or shipping the object 172 in the retention packaging assembly 100. In some embodiments, the retention packaging assembly 100, including the frame 102 and the sheet 164, is made from materials deemed to be recyclable. In this way, a recipient of the package with the object is able to remove the object 172 from the package and recycle the entire the retention packaging assembly 100 (e.g., without having to remove the sheet 164 from the frame 102 in order to recycle the retention packaging assembly 100).

Figure 10A:
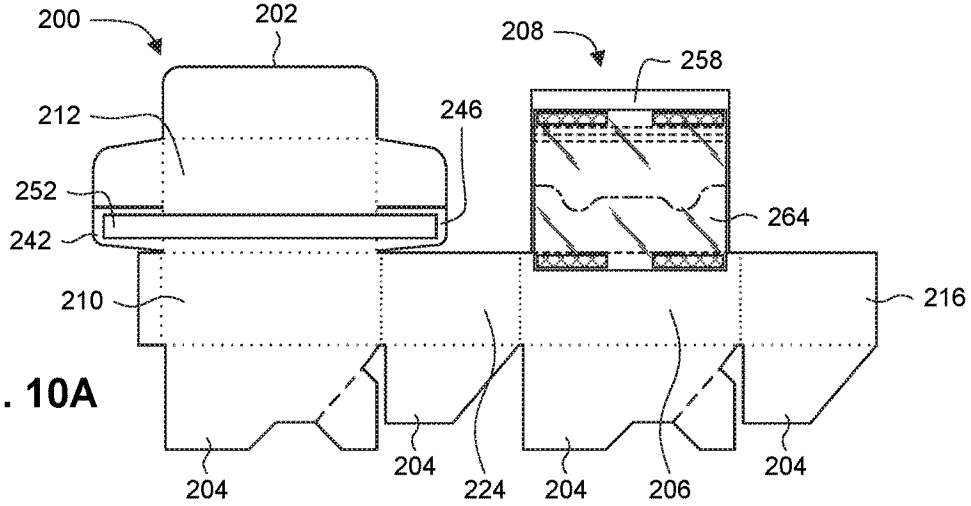
FIGS. 10A to 10C depict another embodiment of a retention packaging assembly that can be folded to form a container.
Figure 10C:
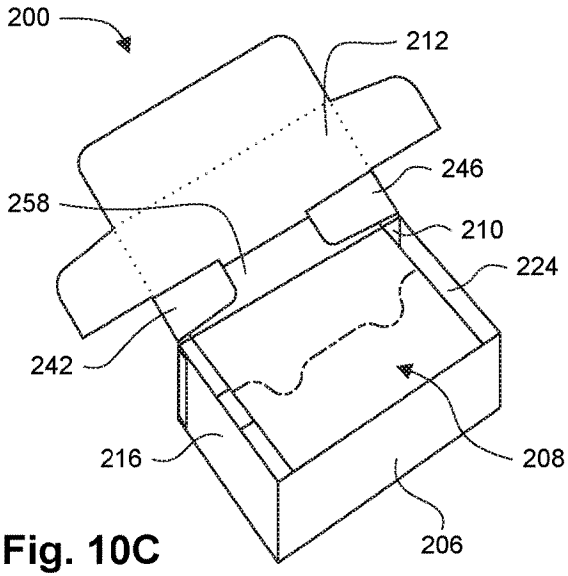
Figure 10B:
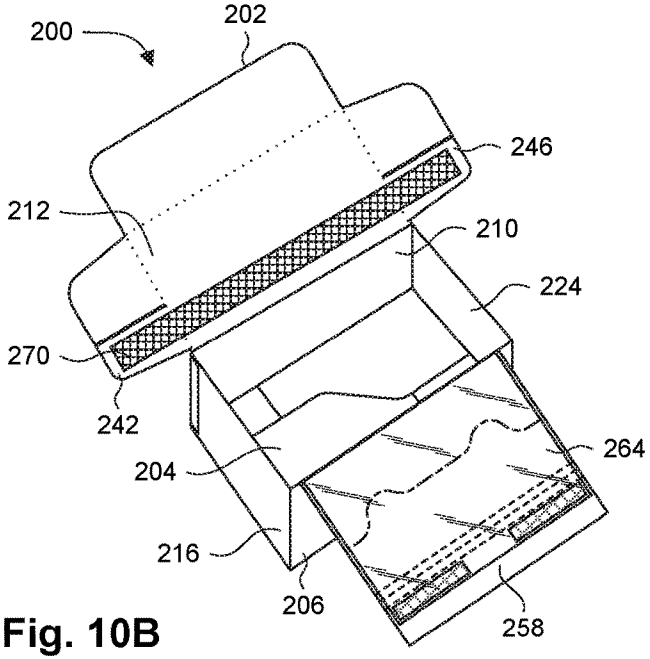

While the embodiment of the retention packaging assembly 100 is formed into the container shown in FIGS. 9A and 9B by folding in a particular manner, any other manner of folding retention packaging assemblies into container can be used. Depicted in FIGS. 10A to 10C is another embodiment of retention packaging assembly 200 that can be folded to form a container. More specifically, FIG. 10A depicts the retention packaging assembly 200 in an unfolded state, FIG. 10B depicts the retention packaging assembly 200 in a first folded state, and FIG. 10C depicts the retention packaging assembly 200 in a second folded state.

The retention packaging assembly 200 includes a frame 202. The frame 202 is configured to be folded into a container. In the depicted embodiment, the frame 202 includes bottom panels 204, a front panel 206, a sheet panel 208, a back panel 210, a top panel 212, a left side panel 216, and a right side panel 224. A fold line is located between each of the bottom panels 204 and the front panel 206, the back panel 210, the left side panel 216, and the right side panel 224, respectively. A fold line is located between the back panel 210 and the top panel 212, and the fold line is located between the front panel 206 and the sheet panel 208. Each of these fold lines represents a foldable connection point between two panels.

The top panel 212 is foldably connected to a left attachment flap 242 and foldably connected to a right attachment flap 246. Depicted in FIG. 10A is a liner 252 located over an attachment zone (not visible in FIG. 10A). In the depicted embodiment, the liner 252 covers a first portion of the attachment zone located on the top panel 212 and a second portion of the attachment zone located on the left attachment flap 242 and the right attachment flap 246. In some examples, the attachment zone is a single continuous attachment zone that extends from the left attachment flap 242, to the top panel 212, and to the right attachment flap 246. In other embodiments, the attachment zone includes multiple distinct portions on the left attachment flap 242, the top panel 212, and the right attachment flap 246. The liner 252 is capable of being removed to expose the adhesive zone to permit the adhesive zone to be adhered to an attachment end 258 of the sheet panel 208.

The retention packaging assembly 200 includes a sheet 264. In the depicted embodiment, the sheet 264 extends from the attachment end 258 of the sheet panel 208 to the front panel 206. In the depicted embodiment, the sheet 264 is attached to the attachment end 258 and the front panel 206 by attachment zones near the corners of the sheet 264. However, the sheet 264 may be attached to the frame 202 in any manner. The sheet 264 may be formed from any of the materials described above with respect to sheet 164.

In some embodiments, the retention packaging assembly 200 is provided in the unfolded configuration shown in FIG. 10A. The frame 202 is configured to be folded from the unfolded state shown in FIG. 10A to the first folded state shown in FIG. 10B. In the first folded state, the frame 202 forms a three-dimensional space that has an opening. The three-dimensional space is bounded by the bottom panels 204 on the bottom, and the front panel 206, the back panel 210, and the left and right side panels 216 and 224 forming the sides. The opening is located at the tops of the front panel 206, the back panel 210, and the left and right side panels 216 and 224. The sheet panel is foldably connected to the front panel 206 at a side of the opening (i.e., at the top of the first panel 206). In the depicted embodiment, the liner 252 has been removed to expose an attachment zone 270.

The frame 202 is configured to be folded from the first folded state shown in FIG. 10B to the second folded state shown in FIG. 10C. In the second folded state, the attachment end 258 of the sheet panel 208 is attached to the attachment zone 270. A first side of the attachment end 258 is attached to a first portion of the attachment zone 270 on the top panel 212 and a second side of the attachment end 258 is attached to a second portion of the attachment zone 270 on the left and right attachment flaps 242 and 246. The sheet 264 also spans from the first side of the opening (i.e., at the top of the front panel 206) to a second side of the opening (i.e., at the top of the back panel 210).

From the second folded state shown in FIG. 10C, the sheet 264 is configured to hold an object at the opening, similar to the way in which the sheet 164 is configured to hold the object 172 at the opening in FIGS. 6B and 7B. The frame is also configured to be folded from the second folded state shown in FIG. 10C to a final folded state. When the frame

202 is in the final folded state, an object held by the sheet 264 is located between the sheet 264 and a portion of the frame 202 that is configured to bias the object toward the sheet 264.

The embodiments of the retention packaging assemblies 100 and 200 are configured to be formed into the containers by folding frames 102 and 202 in particular manners. However, other embodiments retention packaging assemblies consistent with the retention packaging assemblies 100 and 200 disclosed herein are capable of being folded into containers in any manner. Thus, any manner of folding retention packaging assemblies into containers may be used consistent with the subject matter claimed herein.

While the above description has used terms, such as "left," "right," "horizontal," "vertical," "upward," downward," and the like, those terms are used with respect to the depictions in the figures and are not intended to be limited to a particular orientation of retention packaging systems. Those skilled in the art will understand that the retention packaging systems described herein are capable of being folded from any orientation and not just in the orientation depicted in the figures. Thus, these terms should not be read as limiting in any way, but merely as a descriptive tool in reference to the specific orientation shown in the figures.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A retention packaging system, comprising:

a frame including a first panel, a second panel, and a sheet panel, wherein the frame is configured to be folded from an unfolded state to a first folded state and from the first folded state to a second folded state;

a sheet attached to the frame across at least a portion of the sheet panel; and an attachment zone having a first portion located on the second panel and at a second portion located on at least one attachment flap foldably connected to the second panel;

wherein, when the frame is in the first folded state, the frame forms a three dimensional space having an opening with the first panel being one side of the three dimensional space and the sheet panel is foldably connected to the first panel at a first side of the opening; and wherein, when the frame is in the second folded state:

an attachment end of the sheet panel is attached to the attachment zone with a first side of the attachment end attached to the first portion of the attachment zone on the second panel and a second side of the attachment end attached to the second portion of the attachment zone on the at least one attachment flap, and the sheet spans from the first side of the opening to a second side of the opening.

2. The retention packaging system of claim 1, wherein, when the frame is in the second folded state, the sheet is configured to hold an object at the opening.

3. The retention packaging system of claim 2, wherein the frame is configured to be folded from the second folded state to a final folded state.

4. The retention packaging system of claim 3, wherein, when the frame is in the final folded state, the object is located between the sheet and a portion of the frame that is configured to bias the object toward the sheet.

5. The retention packaging system of claim 1, wherein the frame includes a bottom panel that forms a bottom of the three-dimensional space and four panels that form four sides of the three-dimensional space.

6. The retention packaging system of claim 5, wherein the four panels include the first panel, a first side panel, a back panel, and a second side panel.

7. The retention packaging system of claim 6, wherein the second panel is rotatably connected to the back panel at the second side of the opening.

8. The retention packaging system of claim 1, wherein the at least one attachment flap includes a first attachment flap foldably connected to a first end of the second panel and a second attachment flap foldably connected to a second end of the second panel.

9. The retention packaging system of claim 8, wherein the attachment zone extends continuously across portions of the first attachment flap, the second panel, and the second attachment flap.

10. The retention packaging system of claim 8, wherein a first side flap is foldably connected to the first end of the second panel and configured to be rotated independently of the first attachment flap, and wherein a second side flap is foldably connected to the second end of the second panel and configured to be rotated independently of the second attachment flap.

11. The retention packaging system of claim 10, wherein, when the frame is in a final folded state, a portion of the first side flap is located between the sheet and a first side of the three-dimensional space and a portion of the second side flap is located between the sheet and a second side of the three-dimensional space.

12. A retention packaging system, comprising:

a frame including a first panel, a second panel, and a sheet panel, wherein the frame is configured to be folded from an unfolded state to a first folded state and from the first folded state to a second folded state;

a sheet attached to the frame across at least a portion of the sheet panel; and an attachment zone having a first portion located on the second panel and at a second portion located on at least one attachment flap foldably connected to the second panel;

wherein, when the frame is in the first folded state, the frame forms a three dimensional space having an opening with the first panel being one side of the three dimensional space and the sheet panel is foldably connected to the first panel at a first side of the opening; and wherein, when the frame is in the second folded state:

an attachment end of the sheet panel is attached to the attachment zone with a first side of the attachment end attached to the first portion of the attachment zone on the second panel and a second side of the attachment end attached to the second portion of the attachment zone on the at least one attachment flap, and the sheet spans from the first side of the opening to a second side of the opening;

wherein the sheet is attached to the sheet panel via a first attachment zone on the sheet panel and a second attachment zone on the first panel;

wherein the sheet panel includes a first flap and a second flap located between the first attachment zone on the sheet panel and the second attachment zone on the first panel; and wherein, when the first and second flaps are located over the opening, the first and second flaps are configured to be rotated away from the sheet to expose a portion of the sheet and permit placement of an object on the exposed portion of the sheet.

13. The retention packaging system of claim 12, wherein, after the object has been placed on the sheet, the first and second flaps are configured to be rotated toward the sheet to bias the object toward the sheet.

14. The retention packaging system of claim 13, wherein, when the frame is in a final folded state, the second panel is configured to be over the first and second flaps and to bias the first and second flaps toward the object.

15. The retention packaging system of claim 1, wherein the attachment of the first side of the attachment end attached to the first portion of the attachment zone on the second panel and the attachment of the second side of the attachment end attached to the second portion of the attachment zone on the at least one attachment flap forms a two-sided attachment of the attachment end.

16. The retention packaging system of claim 7, wherein the back panel is foldably connected to the base panel.

* * * * *